United States Patent [19]

Yokoi

[11] Patent Number: 4,508,336

[45] Date of Patent: Apr. 2, 1985

[54] GAME DEVICE

[75] Inventor: Gunpei Yokoi, Kyoto, Japan

[73] Assignee: Nintendo Co., Ltd., Kyoto, Japan

[21] Appl. No.: 565,012

[22] Filed: Dec. 22, 1983

[30] Foreign Application Priority Data

Dec. 31, 1982 [JP] Japan ..... 57-201863

[51] Int. Cl.[3] ..... A63F 7/02; A63F 7/30

[52] U.S. Cl. ..... 273/1 L; 273/1 GC; 273/121 B

[58] Field of Search ..... 273/1 L, 1 GC, 121

[56] References Cited

U.S. PATENT DOCUMENTS

| | | | |
|---|---|---|---|
| 489,851 | 1/1893 | Davids | 273/121 R |
| 593,794 | 11/1897 | Wade | 273/121 R |
| 2,112,255 | 3/1938 | Swenson | 273/121 A |
| 2,123,095 | 7/1938 | Burlo | 273/121 R |
| 2,199,327 | 4/1940 | Ahrens | 273/121 A |
| 2,520,283 | 8/1950 | Koci | 273/121 A X |
| 4,136,872 | 1/1979 | Matsumoto | 273/1 L X |
| 4,382,597 | 5/1983 | Minami | 273/1 L |
| 4,438,928 | 3/1984 | Wiczer | 273/121 R |

FOREIGN PATENT DOCUMENTS

| | | | |
|---|---|---|---|
| 767039 | 4/1934 | France | 273/121 R |
| 8176 | of 1914 | United Kingdom | 273/121 B |

*Primary Examiner*—Paul E. Shapiro

*Attorney, Agent, or Firm*—Koda and Androlia

[57] ABSTRACT

A game device comprising a water tank, balls having specific gravity of slightly larger than the liquid in the water tank, a pair of ball passing detecter, and a pair of control means for controlling the movement of the detecting devices. The game is played by utilizing the random changes of courses through which descending balls pass.

2 Claims, 8 Drawing Figures

GAME DEVICE

BACKGROUND OF THE INVENTION

1. Field of the Invention

This invention relates to a game device and more particularly, to a game device including a water tank and balls in it which is played by utilizing the random change of courses which the descending balls pass through.

2. Prior Art

As a prior art to the present invention, there is given Japanese Utility Model Publication No. 31909/1982 which was invented by the inventor of the present invention. This prior art discloses a game device including a water tank, a rising passage at the central part of the water tank, a pair of descending passages made at both sides of the rising passage, numerous balls which pass through the descending passages, scoring zones with a plurality of scoring passages provided at each one of the descending passages, and ball passing detecting devices which are movable in linkage with each other in the direction transversing the scoring passages and determine the effective scoring passage by specifying one of plural scoring passages by its position.

In the above art, a pair of ball passing detecting devices are designed such that they move in linkage with each other for quick moving operation of the ball passing detecting device to enable the players to acquire high standard of technique for achieving big scores. In actual games, however, it is difficult to correspond at all times an effective scoring passage with the scoring passage through which the balls pass in each descending passage; therefore, only one of the two descending passages is operated deliberlately for moving, but the other is moved as if it were a follower. Thus, at one of the descending passages game scores are determined contingently and the game scores do not necessarily depend upon the skill of the player but are partly affected by contingency.

SUMMARY OF THE INVENTION

An object of the present invention is, in the game device of this kind, to lessen the possiblity determined by contingent element and, instead, to enhance the degree which reflects the skill of a player.

The present invention provides a game device including a water tank, a rising passage made at the central part of the tank, a pair of descending passages made at both sides of the rising passage, scoring zones with a plurality of scoring passages provided at each one of the descending passages, ball passing detecting devices which are movable in the direction transversing the rising passage and determine the effective scoring passage by specifying one of the scoring passages by its position, and balls which move up and down in the water tank, wherein each of the descending passages is provided with respective ball passing detecting device which is operable independently for moving and is equipped with respective moving control means, for which a means to move selectively in linkage with the moving control means is provided.

BRIEF DESCRIPTION OF THE DRAWINGS

The nature and advantages of the present invention will be understood more clearly from the following description made with reference to the accompanying drawings, in which.

DETAILED DESCRIPTION OF THE INVENTION

Figure 2:
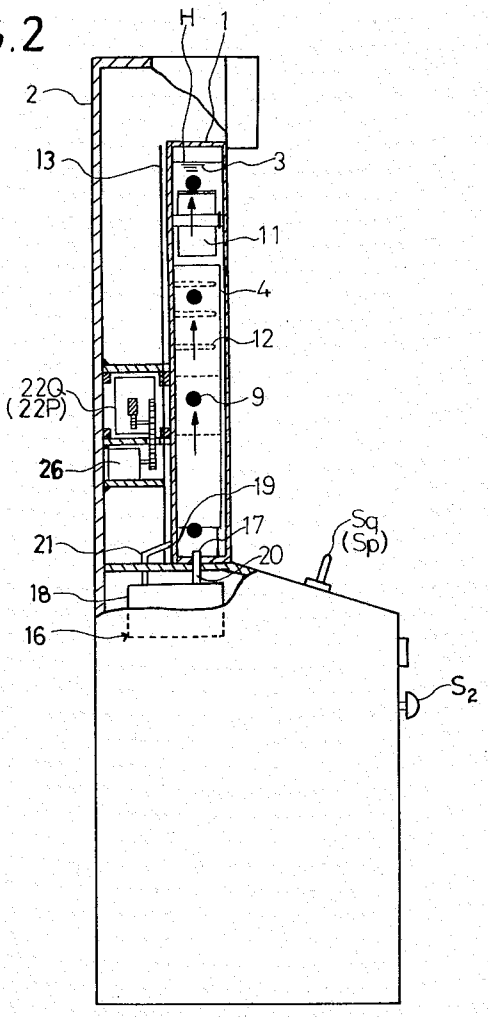
FIG. 2 is a cross section taken along the line 2—2 of FIG. 1.

Numeral 1 denotes a water tank fixed in an upright frame 22. This water tank 1 is made of glass, transparent plastics, or the like so that it can be seen through from the outside and is filled with the water or a proper liquid 3. The water tank 1 is porvided at its central part with a pair of partition walls 4 arranged vertically to form a rising passage. Lower ends and upper ends of the partition walls 4 are away from a bottom surface 5 of the water tank 1 and from a liquid surface H of the liquid 3 in the water tank 1. A pair of descending passages B are formed between the partition walls 4 and both side walls 6 of the water tank 1.

Formed at each one of the descending passages B are scoring zones P and Q, each including scoring passages $P_1$, $P_2 \ldots P_5$, and $Q_1$, $Q_2 \ldots Q_5$ for letting balls 9 which are descending, pass through there by means of a plurality of short walls 7 and introducing pieces 8. Provided at the lower part of the water tank 1 are flowing down plates 10 for flowing down the descended balls 9 toward the bottom of the water tank below the rising passage A. Provided at the upper part of the water tank 1 are vanes 11. Numeral 12 denotes pins for changing the flowing down direction of the balls 9.

The depth of the water tank 1 is shorter than that of the frame 2 but is larger than the diameter of the ball 9. The partition walls 4, short walls 7, flowing down plates 10, and pins 12 are shorter than the depth of the water tank 1 but are larger than the diameter of the ball 9. They are fixed at the rear or the front surface of the water tank 1 or fixed to a transparent plastic plate provided along the rear surface of the water tank 1 and are made of stained plastic plates of proper color.

Numeral 13 denotes a figured plate provided behind the water tank 1. Only the scoring zones P and Q, a timer window 14 for indicating the time of game progress, and a scoring window 15 for indicating scores are made transparent, but all the other parts are drawn with pictures of fishes, water plants and landscape in the water, etc.

Numeral 16 denotes a rising water current generator having a pump circulating and water supply mechanism including a jet nozzle 17 which is below the rising passage A and projects into the water tank 1 from the bottom surface 5 of the water tank; an electro-driven pump 18 fixed in the frame 2; water intake 19 opening at a proper place in the water tank 1; and pipes 20 and 21. This generator 16 may be compsoed in such a fashion that an air jetting port is at the position of the jet nozzle 18, an air pump and an air jetting port are communicated with each other by a pipe and thus air bubbles which reach the water surface H from the air jetting port through the rising passage A are generated continuously. So long as the mechanism is such that the rising water current which goes up from the bottom surface 5 toward the liquid surface H is generated at the rising passage A, the purpose of the present invention can be attained.

The ball passing detecting devices 22P and 22Q are installed in such a fashion that their light emitting parts 23 and light recieving parts 24 are exposed to the front of a case 25 which is movable in the lateral direction and is positioned at the back of the back wall of the water tank 1 and at the back of the scoring zones P and Q.

Figure 4:
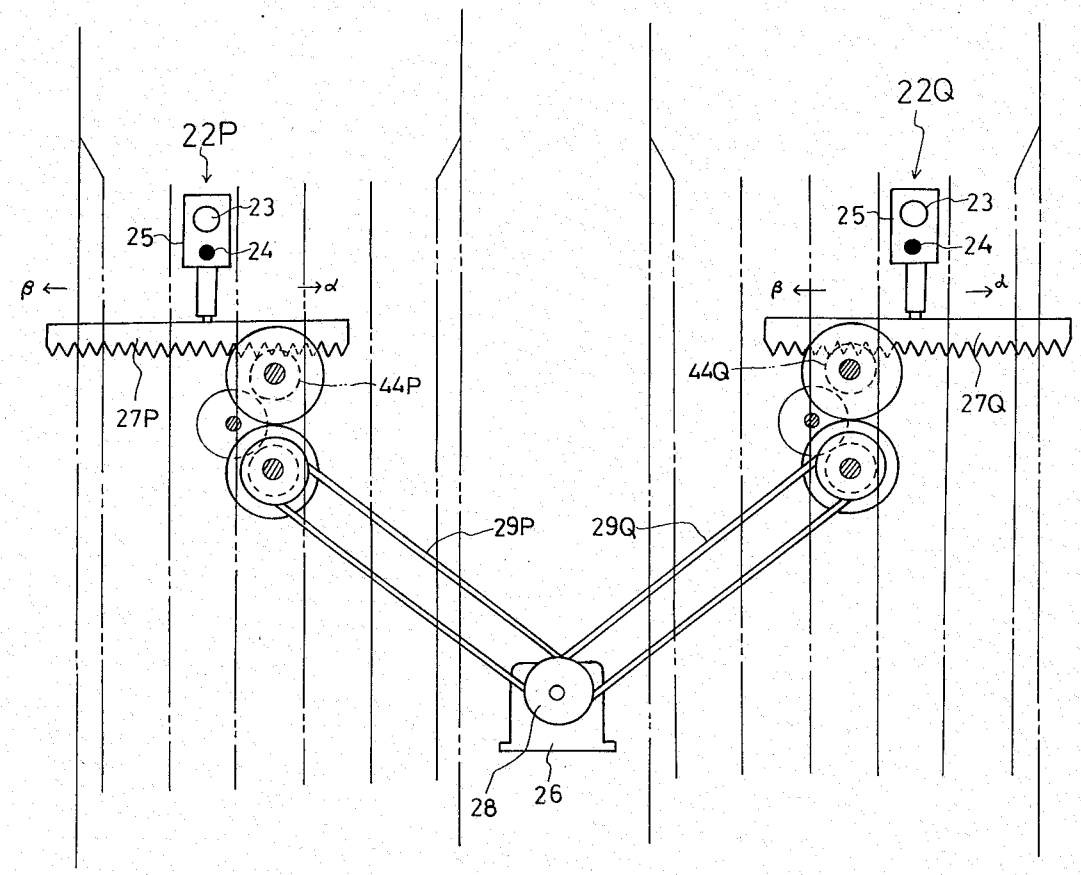
FIG. 4 is a front view of one embodiment of the moving control means for a ball passing detecting device.
Figure 3:
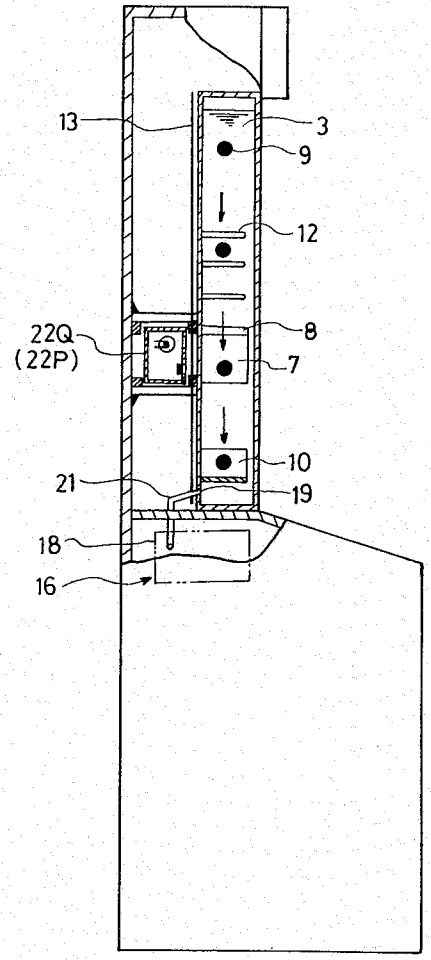
FIG. 3 is a cross section taken along the line 3—3 of FIG. 1.
Figure 6:
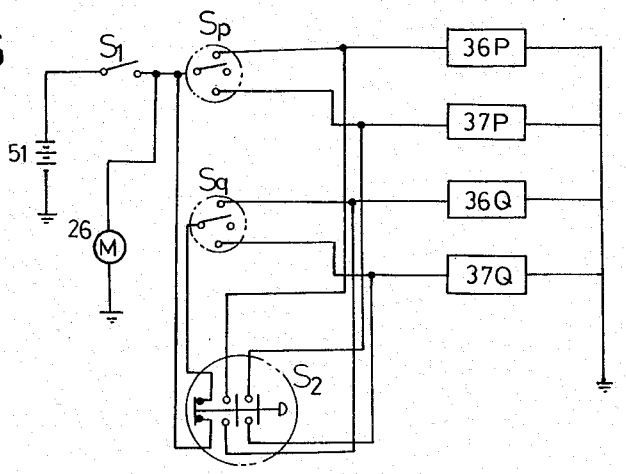
FIG. 6 is an electric circuit diagram of the moving control means shown in FIG. 4.
Figure 5:
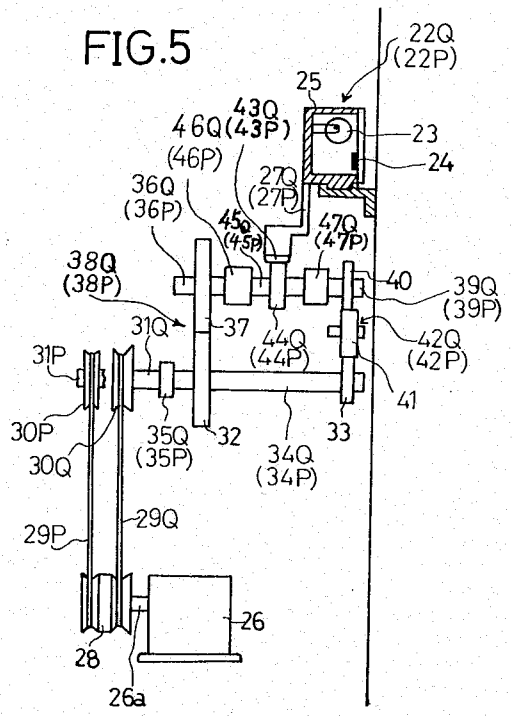
FIG. 5 is a side view of the moving control means shown in FIG. 4.

FIGS. 4, 5 and 6 show the first embodiment of the moving control means for the above-mentioned pair of ball passing detecting devices 22P and 22Q and the driving mechanism. For moving selectively, either in the rightward direction $\alpha$ or the leftward direction $\beta$, the cases 25 and the driving plates 27P and 27Q by a single motor 26, motive power is transmitted from the motor to rotary axes 31P and 31Q through a pulley 29, belts 29P and 29Q and pulleys 30P and 30Q which are fixed to a motor axis *26a*. Power is further transmitted from the rotary axis 31P and 31Q to axes 34P and 34Q fixed to gears 32 and 33 through overload clutches 35P and 35Q. Normal rotation transmitting mechanisms 38P and 38Q which are between axes 34P and 34Q and axes 36P and 36Q are composed by engaging a gear 37 fixed to the axes 36P and 36Q with the gear 32. Reverse rotation transmitting mechanisms 42P and 42Q which are between axes 39P and 39Q and axes 34P and 34Q are composed by transmitting the power from a gear 40 fixed to the axes 39P and 39Q to the gear 33 through an idle gear 41. The power is further transmitted from axes 45P and 45Q fixed to pinions 44P and 44Q which are engaged with the driving plates 27P and 27Q and racks 43P and 43Q to the axes 34P and 34Q through normal rotation clutches 46P and 46Q and also to the axes 39P and 39Q through reverse rotation clutches 47P and 47Q.

With the above arrangement, the driving plates 27P and 27Q, which are integral with the racks 43P and 43Q, are caused to move in the direction $\alpha$ of the working of normal rotation clutches 46P and 46Q and non-working of the reverse rotation clutches 47P and 47Q and then move in the direction $\beta$ by the working of reverse rotation clutches 47P and 47Q and working of normal rotation clutches 46P and 46Q.

FIG. 6 shows one of a control means for the above-mentioned normal rotation clutch 36P and 36Q and reverse rotation clutch 37P and 37Q. The clutches 36P, 36Q, 37P, and 37Q are all electromagnetic clutches. The left lever switch Sp for controlling the movement of the left ball passing detecting device 22P provided at the control plate *2a* at the front of the machine frame 2, the right lever switch Sq for controlling the movement of the right ball passing detecting device 22Q and an interlocking switch $S_2$ are added to the motor circuit of an electric cell E, a main switch $S_1$ of coin timer system and a motor 26. The left lever switch Sp and the right lever switch Sq can be of push button type only in $\alpha$ direction and $\beta$ direction respectively.

When the interlocking switch $S_2$ is in a working position, the circuit of the right lever switch is opened and all the clutches 36P, 36Q, 37P, and 37Q are controlled by the left lever switch Sp. Thus, the movements of the left and right ball passing detecting devices 22P and 22Q are controlled simultaneously by the operation of the left lever switch Sp.

Figure 7:
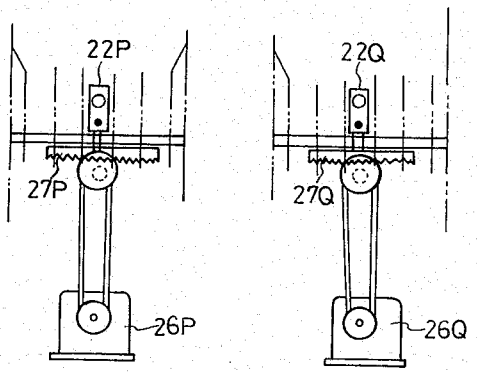
FIG. 7 is a sketch of the driving mechanism of the second embodiment of the moving control means for a ball passing detecting device.
Figure 8:
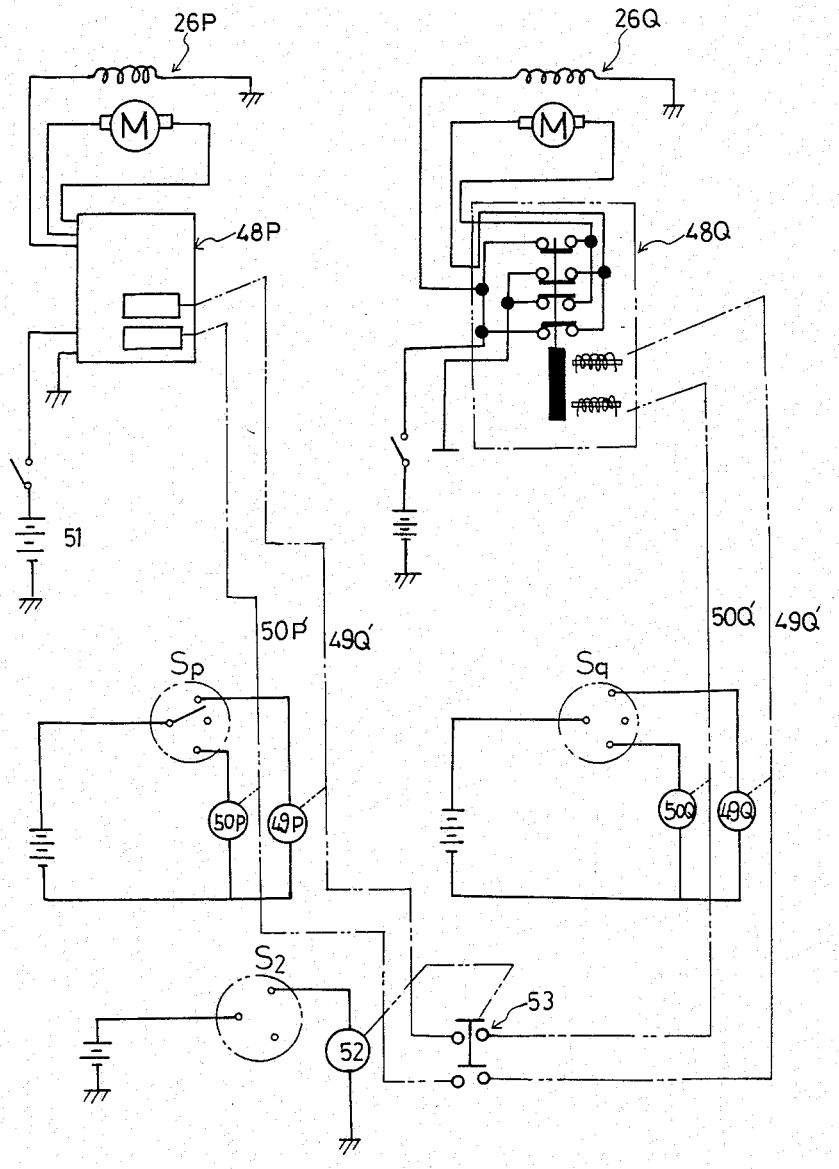
FIG. 8 is an electric circuit diagram of the driving mechanism of the second embodiment shown in FIG. 7.

In the second embodiment shown in FIGS. 7 and 8, two motors 26P and 26Q are provided in order to drive the left and right ball passing detecting devices individually. Instead of the normal rotation clutches 46P and 46Q and the reverse rotation clutches 37P and 37Q provided in the first embodiment, electromagnetic switches 48P and 48Q for switching normal and reverse rotation and relays 50P and 50Q for reverse rotation are provided. For example, when the left lever switch Sp is in a reversing position "$\beta$," the circuit of the relay 50P for the reverse rotation is connected to an electric cell 51. The relay 50P then works and excites a solenoid for reversing position of the electeomagnetic switch 48P, with the result that the electromagnetic switch 48P is in a reversing position, and the rotation of the motor 26P is reversed.

If the interlocking switch $S_2$ is turned on, the relay 52 is worked and the relay contact point is closed, whereby the right and left relay circuits 50P', 50Q', 49P' and 49Q' are connected and both motors 26P and 26Q are turned normal or reverse simultaneously by either one of the switches Sp or Sq.

By the selection of the relay circuits 50P', 50Q', 49Q' and 49Q', it is possible to make both detecting devices draw near each other at the center, separate from each other or move in the right and left directions.

Stoppers, limit switches, etc. are provided so as to limit the movable range of the both detecting devices 22P and 22Q.

Referring to the detecting devices 22P and 22Q, in the above-mentioned embodiment, light from the luminous part 23 (a filament miniature electric bulb) is reflected upon the surface of the ball 9 and is made incident upon a light receiving part 24 (a photoelectric element), from which an output signal is given to detect the ball 9 passing through. It is possible to move a microswitch in a lateral direction of the scoring zones P and Q with its operating piece projecting to the scoring passage in the water tank and to work the microswitch by the contact of the ball 9 with the working piece of the microswitch so as to detect the passing through of the ball.

The specific gravity of the ball 9 is selected such that the ball rises in the rising passage A with the rising water current generated by the rising water current generator 16, and then it reaches near the surface of water H, it descends the descending passage B at a moderate speed, namely, its specific gravity is larger than the liquid in the water tank.

The balls 9 are made of colored synthetic resin such as red, yellow, green, etc., so as to make a player easy to see. In the detecting device of the photoelectric type, it is desirable to make its surface lustrous and brilliant in color so as to better the reflection of light.

Figure 1:
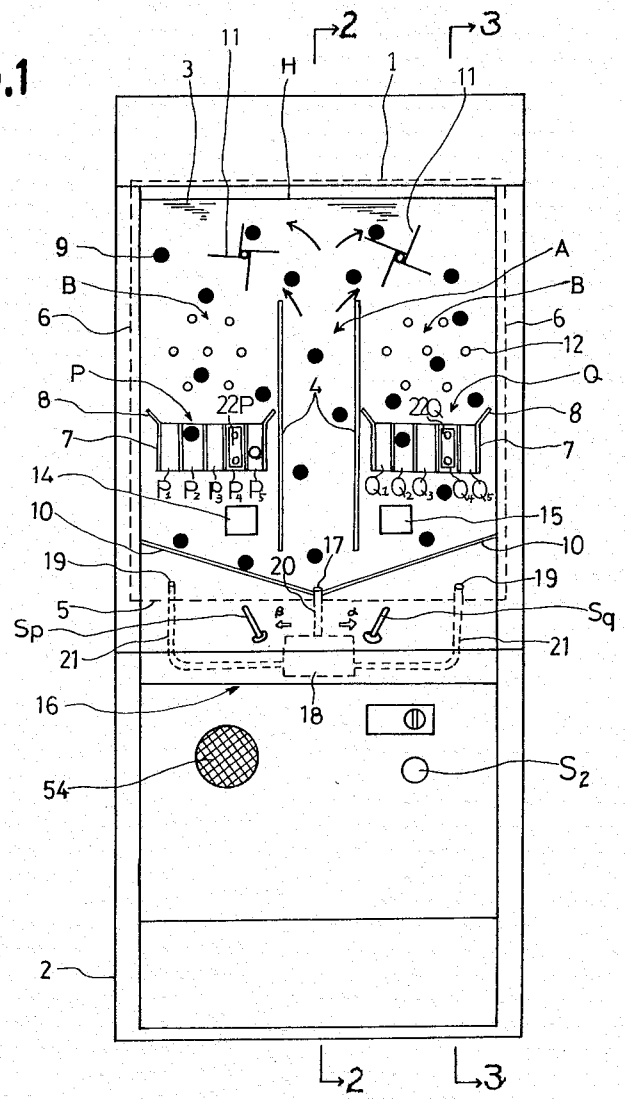
FIG. 1 is a front view of the game device according to the present invention.

In FIG. 1, numeral 54 denotes a speaker for generating an electronic hitting sound and music for indicating the game time, etc.

In playing a game, two loops of water current (water current is divided into two descending passages B from the rising passage A and again reaches the lower part of the rising passage A) are generated and therefore the balls 9 which rose up the rising passage A are divided almost equally into both sides as indicated by arrows and enter into the descending passages B, where they descend slowly as they are changing randomly in descending position due to impellers 11, pins 12 and the like and pass through any one of the scoring passages ($P_1$, $P_2$ . . . $P_5$) ($Q_1$, $Q_2$ . . . $Q_5$) of the scoring zones P and Q. At this time, by the operation of the left lever switch Sp, right lever switch Sq and the interlocking switch $S_2$, the detecting devices 22P and 22Q are moved individually and a score is made when the scoring passage through which the ball 9 passes coincides with the scoring passage where the detecting device 22P or 22Q is positioned.

If the detecting devices 22P and 22Q move to both sides of the socring passage or move outward or inward of the scoring passage, they strike against the stopper, whereby a load increases and the overload clutches 29P and 29Q work to stop the movment of the detecting devices 22P and 22Q. In the second embodiment, the motor 26 is stopped by the operation of the limit switch, and at the portions where the balls 9 pass through a pair of scoring zones P and Q are almost equal and change randomly. Therefore, in order to make a score at both scoring zones P and Q, it is required to move the detecting devices 22P and 22Q quickly, and to earn higher score, a player is required to operate the both left lever switch Sp and the right lever switch Sq, simultaneously.

When children play the game, the movements of the ball passing detecting devices 22P and 22Q can be controlled by a single switch Sp or Sq by turning the interlocking switch $S_2$ on. When two people play, the interlocking switch $S_2$ is positioned OFF so that each player operates the switch Sp or Sq, individually.

As stated above, according to the present invention a rising passage is provided at the central part of the water tank, a pair of descending passages are provided on the both sides of the rising passage, balls in almost equal number are passed through the scoring zones formed at the both descending passages, a pair of balls passing detecting devices are provided, and means for controlling the movement of each one of the ball passing detecting devices are provided. Therefore, in operating the movement of the detecting device, it is necessary to move the detecting device to the specific scoring zone through which the ball passes by timing the movement to the expected descending direction and descending the speed of the ball. Thus, a high standard of skill is required for players, while decreasing the score due to contingency and enhancing the commodity value of this game device.

Means for controlling the movement of the detecting devices is provided for each one of the pair of detecting devices; therefore, in the case of a single player, the player operates such means for controlling the movements on both sides simultaneously by using both hands, and the highest score is earned only when the operating time at both sides is good. Thus, a higher standard of skill is required and the commodity value of the game device of this kind is enhanced. In the case of two players, each player can play a game by operating either one of a pair of means for controlling the movement of the detecting device. Thus, the present invention provides a game device for two players, as well as for a single player.

Moreover, according to the present invention an inter-locking mechanism is added to a pair of means for controlling the movement in order to operate a pair of ball passing detecting devices independently; therefore, in the case of a single and young player who has a poor skill and wants to make a score by contingency, the game can be played by operating only one of the pair of means for controlling the movement, and thus the range of players of the game device of this kind can be expanded.

I claim:

1. A game device including a water tank which contains balls having a specific gravity of slightly larger than that of the liquid in the water tank, said game device being characterized in that it is provided with:

a rising passage at the central part of the water tank and a pair of descending passages on both sides of the rising passage by a vertical partition wall;

a rising water current generator below the rising passage;

a scoring zone comprising a plurality of scoring passages for each of the pair of descending passages;

a pair of ball passing detecting devices to determine an effective scoring passage among a plurality of scoring passages and a pair of control means for controlling the movement of the ball passing detecting device to make the effective scoring passage changeable.

2. A game device as defined in claim 1, further comprising an interlocking means which is provided for each one of said control means.

* * * * *